US005215275A

United States Patent [19]

Gold

[11] Patent Number: 5,215,275

[45] Date of Patent: Jun. 1, 1993

[54] PLASTIC BAGS ROLL AND METHOD FOR MAKING SAME

[76] Inventor: Paul Gold, 250 Hammond Pond Pkwy., Unit 501N, Chestnut Hill, Mass. 02167

[21] Appl. No.: 658,071

[22] Filed: Feb. 21, 1991

Related U.S. Application Data

[63] Continuation-in-part of Ser. No. 530,882, May 30, 1990, abandoned.

[51] Int. Cl.[5] ..... B31B 27/14

[52] U.S. Cl. ..... 242/56.8; 493/194; 493/238

[58] Field of Search ..... 53/567; 493/193, 194, 493/195, 196, 197, 198, 199, 916, 237, 238; 242/56.8; 383/35

[56] References Cited

U.S. PATENT DOCUMENTS

| | | | |
|---|---|---|---|
| 2,054,298 | 9/1936 | Poppe | 383/35 X |
| 2,097,745 | 7/1936 | Poppe | 383/35 X |
| 2,225,288 | 12/1940 | Woehlert | 493/238 |
| 2,254,907 | 9/1941 | Potdevin et al. | 493/237 X |
| 2,640,540 | 6/1953 | Stange | 493/238 X |
| 2,854,898 | 10/1958 | Vogt | 493/193 |
| 3,269,278 | 8/1966 | Olstad | 493/197 |
| 3,508,473 | 4/1970 | Ericson | 493/194 |
| 3,511,435 | 5/1970 | Hewitt et al. | 493/197 X |
| 3,804,322 | 4/1974 | Ericson | 383/35 X |
| 3,823,887 | 7/1974 | Gerstein | 242/56.8 X |
| 3,979,050 | 9/1976 | Cilia | 383/35 X |
| 4,046,065 | 9/1977 | Plate | 493/194 |
| 4,166,412 | 9/1979 | Versteege | 493/193 |
| 4,277,241 | 7/1981 | Schulze | 493/196 |
| 4,285,681 | 8/1981 | Walitalo et al. | 493/194 |
| 4,526,565 | 7/1985 | Hummel et al. | 493/196 |
| 4,652,253 | 3/1987 | Benoit et al. | 493/238 X |
| 4,747,815 | 5/1988 | Benoit et al. | 493/194 |
| 4,849,090 | 7/1989 | Case et al. | 493/194 X |
| 4,904,092 | 2/1990 | Campbell et al. | 383/35 |
| 5,001,956 | 3/1991 | Nitsch | 493/238 X |

FOREIGN PATENT DOCUMENTS

| | | | |
|---|---|---|---|
| 856516 | 11/1920 | Canada | 493/194 |
| 1094084 | 12/1960 | Fed. Rep. of Germany | 493/196 |
| 8400322 | 2/1984 | World Int. Prop. O. | 493/194 |

*Primary Examiner*—Joseph J. Hail, III
*Assistant Examiner*—John P. Darling

[57] ABSTRACT

A process for making a roll of plastic bags made from a two-ply web sealed along its sides. Perforations for the top edges of each bag are made simultaneously and separately in each of the two plys of the web forming the bag. The bottom of each bag is formed by a transverse seal. To further enhance ease of opening, at least a portion of the top edge on one ply of the bag is non-coincident with the top edge on the other ply of the bag.

4 Claims, 2 Drawing Sheets

PLASTIC BAGS ROLL AND METHOD FOR MAKING SAME

This is a continuation-in-part of copending application(s) Ser. No. 07/530,882 filed on May 30, 1990, now abandoned.

BACKGROUND OF THE INVENTION

The present invention is directed to a roll of plastic bags, such as those used in the produce sections of supermarkets, at a dry cleaners, to cover hanging clothes, or in homes for use as trash bags, and to a method for making the same.

Many shoppers have experienced the frustration of tearing a bag off a roll of plastic bags coupled with the difficulty encountered in attempting to separate the two plys when attempting to open the bag. The two plys of the bag are often held together by static electricity and, more importantly, the open ends of the bag are often secured to one another by the serration process which formed perforations in the roll required for separating the bags from one another. In the conventional roll of plastic bags when the roll is serrated, both plys of the bag are serrated simultaneously in a straight line across the top of each succeeding bag. The serrating blades, in creating the perforations, push each ply of the bag into each other so as to form the perforations. Since the plastic is a stretchable material, to some degree, this serration process causes the edges of the bag to become interlocked with each other, making it difficult for consumers to separate the plys and open the bag after ripping it from a roll. This problem is exacerbated by the act of ripping the bag from the roll which causes the edges of the plys to become more strongly bonded or locked together.

It is one object of the present invention to provide a roll of plastic bags which are easy to open. In doing so, it is the object of the present invention to make shopping easier, faster and less annoying.

It is another object of this invention to provide a process for making a bag which avoids the problem of the edges two plys of the bag being interlocked to each other.

SUMMARY OF THE INVENTION

In the method for making a roll of plastic bags of the present invention, the top ends of the two plys which make up each bag are preferably perforated simultaneously, but separately, so as not to cause the two edges to be locked together. Moreover, in accordance with the process of the invention, the perforations in each ply of the bag are made substantially non-coincident—i.e., the perforations on one ply of the bag is not in registration with the perforations in the other ply. This will further facilitate the opening of the bag as will be explained in greater detail below.

A roll of bags made in accordance with the process described herein will be characterized by each bag consisting of two plys sealed along the bottom and sides and perforated along the top edge of the bag with perforations that are not coincident with each other. In accordance with one embodiment of the bags of the invention, one ply of each bag on a roll of bags has a straight line perforation and the other ply has an arcuate perforation which coincides with the straight line perforation only at the sides or edges of the bag whereby the perforations are not in registration with each other.

Since the perforations in each ply of the bag are preferably made simultaneously and separately, there is no interlocking effect. Thus, the bag can be easily opened.

Other objects and advantages of the invention will become apparent during the following description of the presently preferred embodiment of the invention taken in conjunction with the drawings.

DETAILED DESCRIPTION OF THE PREFERRED EMBODIMENTS

Figure 1:
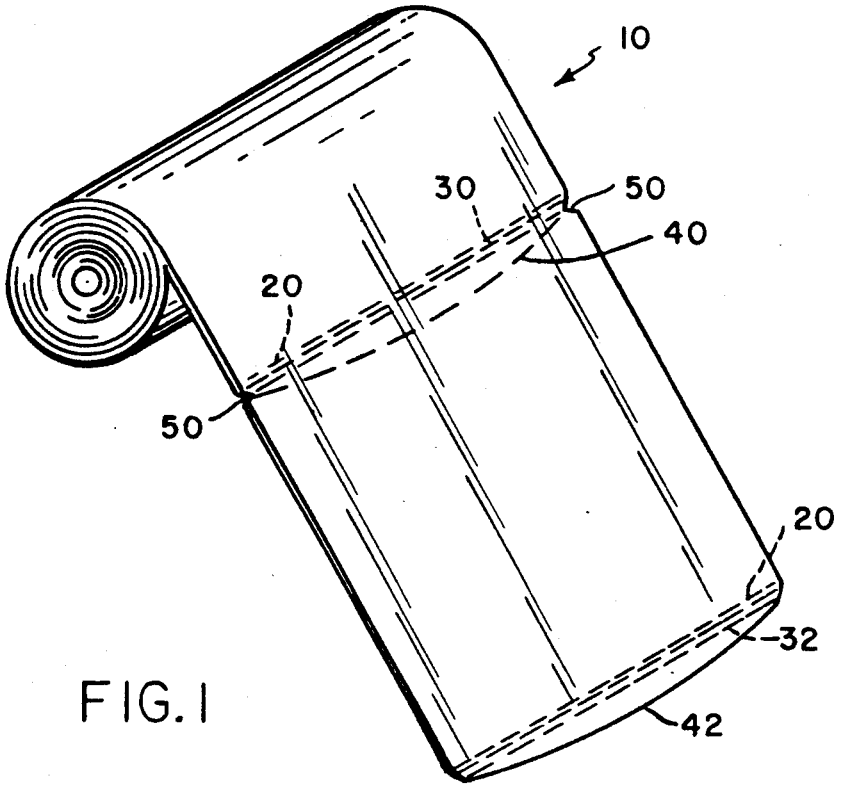
FIG. 1 is a perspective view of a roll of plastic bags made by the method of the present invention.

Referring now to the drawings, in FIG. 1 the roll 10 of plastic bags of the present invention is shown. The plastic bag roll is generally made from extruded plastic film such as a film extruded in the form of a tube and slit into two flexible parallel sheets in face to face registration with each other. The tube may be of any flexible plastic material. The roll of plastic bags is made from the continuous two-ply web of plastic material.

The two-ply tubular web of material is first slit and then subdivided into a series of interconnected plastic bags. The bottom of each bag is formed by a transverse seal 20 which extends from one side of the web to the other side of the web. Conventionally, the seal 20 is formed by a heat sealing process in which the web is melted across its width so as to permanently bond and form the bag.

Just below each seal 20, the web is preferably simultaneously and separately perforated to form the top edges of each successive plastic bag and then the sides of the web are heat sealed to form the bags. In accordance with the present invention, the perforations in each of the two plys of the web are preferably formed simultaneously and separately so that they do not stick together or interlock. To ensure that there is no interlocking of the perforations on each of the plys of the web, it is desirable that the perforations are substantially non-coincident or out of registration with each other. In the plastic bag roll 10 of FIG. 1, the bottom ply has a straight line perforation 30. The top ply of the plastic bag roll is provided with an arcuate perforation 40. The arcuate perforation 40 only coincides with the straight line perforation 30 at the sides of the web. At the point of coincidence a piece of the web may be optionally cut out from the side of the web to form a nip 50. The nip 50 on the roll would facilitate tearing a bag from the roll.

Figure 2:
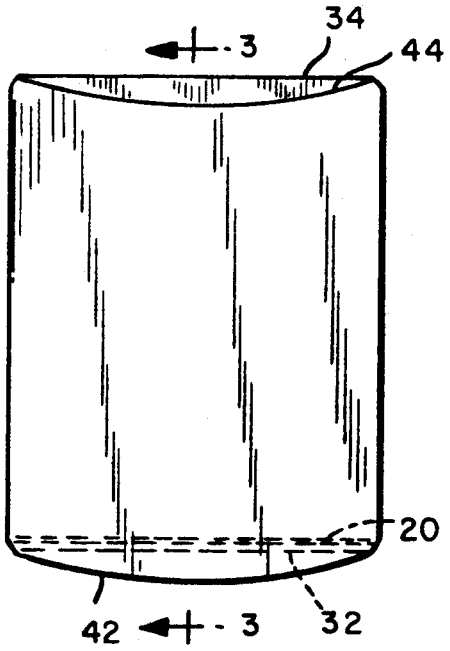
FIG. 2 is a plan view of a plastic bag from the roll of FIG. 1.
Figure 3:
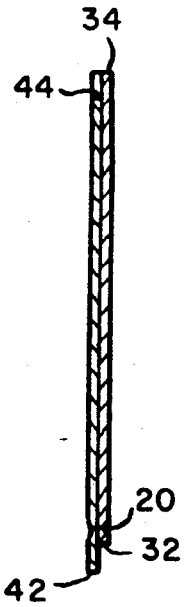
FIG. 3 is a sectional view of the bag of FIG. 2.

Referring now to FIGS. 2 and 3, a plastic bag is shown after having been torn off from a plastic bag roll 10. Upon ripping a plastic bag from the roll the perforation 30 leaves a top edge 34 on the plastic bag. The bag remaining on the roll forms a bottom edge 32, also corresponding to the perforation 30. The perforation 40 leaves an arcuate top edge 44 on each plastic bag. Since perforations 30 and 34 were formed in simultaneous and separate operations and since they form edges which are non-coincident or in registration with one another, it is a simple matter for a consumer to separate the edge 34 from the edge 44 to open the bag and make use of it.

The arcuate perforation 40 forms a bottom edge 42 at the bottom of each bag. This, in effect forms a flap at the bottom of each bag which is superfluous, however, the advantages of the easy open top far outweighs the inclusion of the superfluous piece of material a the bottom of each bag.

As used in this application, the term "substantially non-coincident" means that at least a portion of the perforation on one edge of a first ply non-coincident with the perforation on the corresponding edge of the second ply.

Figure 4:
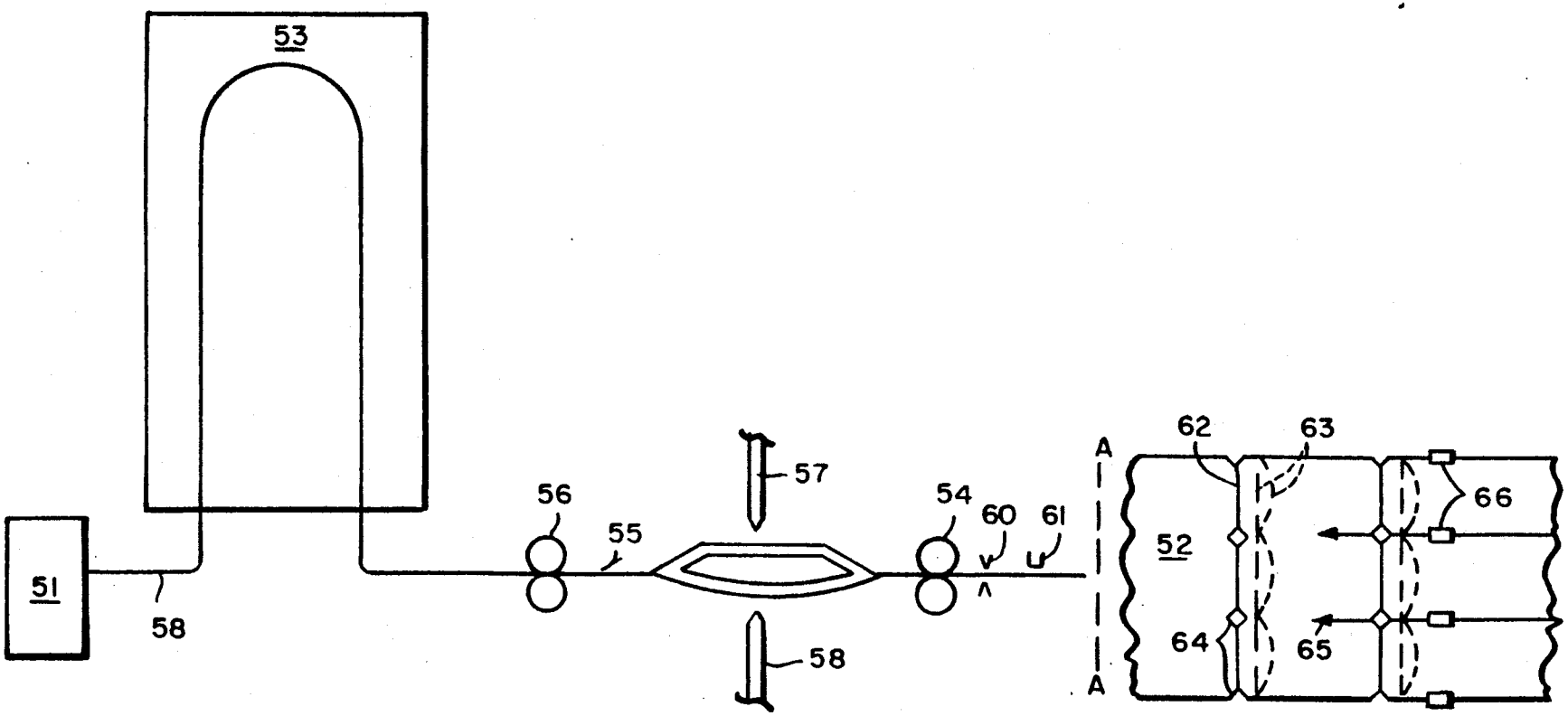
FIG. 4 is a flow diagram representing the process used to make the roll of plastic bags in accordance with the invention.

The conventional method of making a roll of plastic bags is altered to achieve the objects of the present invention. One process for making the roll of bags of the invention is diagrammatically illustrated in FIG. 4 of the drawings which in part is a side diagrammatic view (first half of the process to dashed line break A—A) and in part a top diagrammatic view (second half of the drawing process from line break A—A). FIG. 4 illustrates one process for making bags in accordance with the invention though other methods of accomplishing the same results would be apparent to those skilled in the art.

The process of FIG. 4 begins with the melting of plastic pellets in a melting hopper with the melted plastic extruded through extruder 51. The extruder utilizes a die or nozzle to extrude the plastic in the form of a continuous web 52 which in the embodiment shown, is tubular in shape. The tube passes through a cooling chamber or tower 53 where the plastic is cooled below its glass transition temperature. After leaving the cooling tower, the tube passes between flattening rollers 54 and thereafter through slitters 55. The slitters are positioned on both sides of the tubular web to remove the edges of the tube and to form two parallel sheets in face to face relationship with each other. The sheets are then separated from each other prior to perforation of the same. One sheet passes over anvil 56 while the other passes beneath anvil 56. The anvil desirably has a series of holes or slots on its upper side and bottom side corresponding to the perforations to be made in the respective sheets of the plastic bags. With the sheets separated from each other by the anvil, a top serrator arm 57, preferably arcuate in form, and a bottom serrator arm 58, preferably straight in form, or visa versa, simultaneously rise and fall transversely cutting perforations in the sheets across their width thus making tearing perforations exactly opposite each other in the top and bottom sheets of film. The process is continuously repeated as the sheets move over and beneath the anvil thereby forming tearing perforations over the continuous web as it passes over and beneath the anvil. The top and bottom perforating arms 57 and 58 are designed to work in unison with each other whereby simultaneous perforations are formed. The method for achieving simultaneous operation should be obvious to those skilled in the art. Since the perforating arms differ in shape, the perforations in the top and bottom sheets are not in registration with each other.

Following formation of the tear perforations, the sheets may then be formed into bags. The sheets would be pulled off the separating anvil 56 such as by a second set of rolls 59. Side notches to facilitate tearing of individual bags from the roll can be placed transversely across the web beginning at the edges of the web by die 60 and the sheets sealed across the width by heating bar 61. In FIG. 4, the balance of the Figure following break line A—A illustrates the process as a top view though it should be understood that this is for purposes of illustration only. As seen from the top view, the web 52 has alternating heat seals 62, top and bottom perforations out of registration with each other 63 and notches 64 to facilitate tearing. As illustrated, three rolls of bags are made longitudinally across the web. It should be understood that the actual number is within the skill of the art and often greater than three.

The next step in the process involves slitting the web longitudinally in the direction of movement of the web using knives 65 or heat slitting and heat sealing the sides of the invdividual bags with heating elements 66, all as would be known with heating elements 66, all as would be known to those skilled in the art. Following slitting and heat sealing, the roll of bags so formed may be printed with advertising material if desired and rolled about itself longitudinally to form several rolls of plastic bags. If desired, a dowel or cardboard tube can be supplied for use as the center of the roll. The machinery for feeding a web over a central separating anvil and then heat sealing the sides of each roll and the bottoms of each bag in proper orientation with the perforations is well within the skill in the appropriate machining and engineering arts.

Advantageously, using this method, the perforations are formed separately and simultaneously about the central separating anvil so that the perforation process does not create interlocking perforations. The presently preferred embodiments disclose perforation configurations which further ensure ease of opening a plastic bag from a roll of plastic bags.

Of course, it should be understood that various changes and modifications to the preferred embodiments described above will be apparent to those skilled in the art. Various configurations for the perforations forming the top edge on each ply of the web may be substituted for those illustrated herein. Such changes can be made without departing from the spirit and scope of the invention and without diminishing its attendant advantages. It is therefore intended that such changes and modifications be covered by the following claims.

I claim:

1. A process for forming a continuous roll of plastic bags comprising:

(a) feeding a first sheet of plastic material over a separating anvil;

(b) feeding a second sheet of plastic material below said separating anvil;

(c) making a series of perforations in said first sheet by applying a serrator against said sheet on top of said separating anvil;

(d) making a series of perforations in said second sheet by applying a serrator against said sheet below said separating anvil;

(e) said first and second series of perforations being made in said sheets separately and simultaneously from each other and out of registration with each other whereby the series of perforations in said first sheet and the series of perforations on said second sheet are essentially noncoincident with each other; and (f) heat sealing said first and second sheets together transversely to form the bottoms of each plastic bag and longitudinally to form the sides of the bag.

2. The process of claim 1 where the series of perforations in said first sheet are arcuate and the series of perforations in the second sheet are straight.

3. The process of claim 1 further comprising notching of the sides of the bag where heat sealed together to facilitate tearing of one bag from another.

4. The process of claim 1 where several rolls of bags are made simultaneously and parallel to each other.

* * * * *